US012371952B2

(12) United States Patent
Laakkola et al.

(10) Patent No.: US 12,371,952 B2
(45) Date of Patent: Jul. 29, 2025

(54) SHANK ADAPTER, ROCK DRILLING MACHINE AND METHOD

(71) Applicant: SANDVIK MINING AND CONSTRUCTION OY, Tampere (FI)

(72) Inventors: Esa Laakkola, Tampere (FI); Jussi Peurala, Tampere (FI); Timo Kela, Tampere (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 0 days.

(21) Appl. No.: 18/277,722

(22) PCT Filed: Feb. 17, 2022

(86) PCT No.: PCT/EP2022/053913
§ 371 (c)(1),
(2) Date: Aug. 17, 2023

(87) PCT Pub. No.: WO2022/175374
PCT Pub. Date: Aug. 25, 2022

(65) Prior Publication Data

US 2024/0133247 A1 Apr. 25, 2024
US 2024/0229571 A9 Jul. 11, 2024

(30) Foreign Application Priority Data

Feb. 19, 2021 (EP) ..... 21158232

(51) Int. Cl.
*E21B 10/23* (2006.01)
*E21B 6/04* (2006.01)
*E21B 10/25* (2006.01)
*E21B 17/10* (2006.01)

(52) U.S. Cl.
CPC ..... *E21B 17/105* (2013.01); *E21B 6/04* (2013.01); *E21B 10/23* (2013.01); *E21B 10/25* (2013.01); *E21B 2200/01* (2020.05)

(58) Field of Classification Search
CPC ..... E21B 10/23; E21B 10/25; E21B 6/04
See application file for complete search history.

(56) References Cited

U.S. PATENT DOCUMENTS 5,680,904 A * 10/1997 Patterson ..... E21B 4/14 173/112
6,109,620 A * 8/2000 Roberts ..... E21B 17/03 228/114.5
6,712,163 B2 * 3/2004 Kleine ..... B23B 51/06 175/320
9,523,245 B2 * 12/2016 Hemph ..... E21B 21/00
(Continued)

FOREIGN PATENT DOCUMENTS

EP 2811106 A1 12/2014
EP 2851502 A1 3/2015
EP 2944756 A1 11/2015

*Primary Examiner* — Catherine Loikith
(74) *Attorney, Agent, or Firm* — Corinne R. Gorski

(57) ABSTRACT

A shank adapter, rock drilling machine and method of mounting a shank adapter of a rock drilling machine inside a slide bearing element. The shank adapter includes a coupling head and a rotation portion at its opposite ends, and a flushing portion located therebetween. Outer diameters of the coupling head and the rotation portion are both greater than outer diameters of portions of the shank adaptor located therebetween.

5 Claims, 4 Drawing Sheets

(56) References Cited

U.S. PATENT DOCUMENTS

| | | | | |
|---|---|---|---|---|
| 10,745,972 | B2 * | 8/2020 | Lejon | E21B 10/38 |
| 12,241,319 | B2 * | 3/2025 | Kela | E21B 7/025 |
| 2005/0208224 | A1 * | 9/2005 | Stenberg | C23C 22/18<br>427/430.1 |

* cited by examiner

SHANK ADAPTER, ROCK DRILLING MACHINE AND METHOD

RELATED APPLICATION DATA

This application is a § 371 National Stage Application of PCT International Application No. PCT/EP2022/053913 filed Feb. 17, 2022 with priority to EP 21158232.5 filed Feb. 19, 2021.

BACKGROUND OF THE INVENTION

The invention relates to a shank adapter of a rock drilling machine. The shank adapter is intended for connecting a drilling tool to the rock drilling machine.

The invention further relates to a rock drilling machine and to a method of mounting a shank adapter of a rock drilling machine inside a slide bearing element.

In mines and at other work sites different type of rock drilling rigs are used. The rock drilling rigs are provided with one or more booms and rock drilling machines are arranged at distal ends of the booms. The rock drilling machine comprises an impact device provided with an impact piston which is configured to provide a drilling tool with impact pulses via a shank adapter. The shank adapter is configured to transmit impact pulses and torque from the rock drilling machine to drilling tool, as well as convey flushing fluid through it to the drilling tool and towards a drill bit. Around the shank adapter are slide bearings and a flushing housing. In known constructions some disadvantages have been detected in shank adapters, and in their mounting.

BRIEF DESCRIPTION OF THE INVENTION

An object of the invention is to provide a novel and improved shank adapter, a rock drilling machine equipped with such shank adapter, and a method for mounting a shank adapter inside bearing elements.

An idea of the disclosed solution is that a shank adapter comprises a coupling head and a rotation portion at its opposite ends. A flushing portion is located between the coupling head and the rotation portion. Outer diameters of the coupling head and the rotation portion are both greater than outer diameters between them.

In other words, the shank adapter has a slim middle section between the thicker ends.

An advantage of the disclosed solution is that when the middle section of the shank adapter is relatively thin, propagation of the stress waves caused by impact pulses of the impact device may be effective.

On the other hand, greater dimension at the coupling head may be advantageous regarding durability of the coupling, and greater dimension at the rotation portion may be advantageous regarding transmission of torque.

Thus, the shank adapter may be dimensioned more freely by taking into account the stress wave propagation efficiency and durability of the shank adapter.

According to an embodiment, the shank adapter comprises a flushing portion and a bearing portion between the mentioned coupling head and the rotation portion. Then, the mentioned outer diameters of the coupling head and the rotation portion are both greater than outer diameters of the flushing portion and the bearing portion.

According to an embodiment, the smallest diameter of the two outer diameters of the coupling head and the rotation portion is at least 5% greater than the greatest outer diameter between them.

According to an embodiment, outer diameters of the coupling head and the rotation portion have different magnitudes.

According to an embodiment, the diameter of the rotation portion is smaller than the diameter of the coupling head.

According to an embodiment, outer diameters of the coupling head and the rotation portion have same magnitudes.

According to an embodiment, the smallest diameter of the two outer diameters of the coupling head and the rotation portion is at least 4 mm greater than the greatest outer diameter between them.

According to an embodiment, the coupling head comprises a shoulder provided with an axial contact surface and a protruding axial part provided with a coupling thread. Then an outer diameter of the shoulder represents the greatest diameter of the coupling head. In other words, the shank adapter provided with the shoulder is known as a shoulder contact adapter. In this embodiment, the shoulder is configured to transmit axially propagating stress waves between the impact device and the shank adapter. Typically, the shank adapters provided with the shoulders i.e. shoulder contact adapters, have longer service life compared to so called bottom contact shank adapters. This is due to the fact that in the shoulder contact adapter temperature of the coupling thread remains at lower levels compared to coupling threads of the bottom contact adapter. The present solution allows use of the shoulder adapters without a need to use large dimensioned bearings and sealings surrounding the shank adapter. Further, the disclosed solution provides an easy, quick and handy way to mount and dismount the shank adapter and to replace worn or damaged machine components surrounding the shank adapter.

According to an embodiment, the outer diameter of the shoulder represents the greatest diameter of the entire shank adapter.

According to an embodiment, the following diameters are implemented in the shank adapter:

diameter D1 (shoulder) is 65-87 mm;

diameter D2 (bearing) is 52-80 mm; and diameter D4 (splines) is 69-79 mm.

According to an embodiment, an alternative bottom contact shank adapter is implemented. Then, the coupling head of the shank adapter comprises a coupling thread an outer diameter of which is greater than the outer diameter of the middle portion between the splines and the coupling thread. Thus, the outer dimension of the coupling thread of the bottom contact adapter can be dimensioned freely without limitations of mounting of the shank adapter, whereby the coupling thread may be larger than typically and may thereby have increased durability when compared to the present bottom contact adapters.

According to an embodiment, the shank adapter is supported axially movably by means of at least one split slide bearing. In other words, the bearing of the shank adapter can be mounted and removed in transverse direction relative to axial direction of the shank adapter.

According to an embodiment, the solution relates to a rock drilling machine comprising: a body; an impact device for generating impact pulses; a shank adapter for receiving the impact pulses and transmitting them as stress waves to a drilling tool connectable to the shank adapter; a rotation device for turning the shank adapter around its longitudinal axis; at least one bearing element for supporting the shank adapter; a flushing head at a front end of the body; and wherein the flushing head comprises a flushing element surrounding the shank adapter and configured to form an annular flushing space for feeding flushing agent through the shank adapter to the drilling tool. Further, the bearing element and the flushing element have both split structures comprising at least two compatible components. The shank adapter is in accordance with the features disclosed in this document.

In the disclosed structure the split flushing element and the split bearing element do not limit the use of different shank adapters. Outer diameters of different axial portions of the shank adapter can be dimensioned more freely when the flushing element can be assembled around the shank adapter in radial or transverse direction. The shank adapter is not mounted in a conventional manner by pushing it axially through the flushing and bearing structures. Due to the split structure and transverse mounting direction of the flushing housing and bearing element, outer diameters of a rotation part, a flushing part and a connecting part of the shank adapter can be dimensioned independently in respect to each other. Then more versatile design choices can be applied.

According to an embodiment, the solution relates to a method of mounting a shank adapter of a rock drilling machine inside a slide bearing element. The method further comprises implementing a split bearing element comprising at least two connectable bearing components. The shank adapter and the split bearing element are connected together by means of transverse relative movement between the shank adapter and the bearing components.

According to an embodiment, the method further comprises pre-assembling the bearing element around the shank adapter and mounting the combination of the shank adapter and the bearing element in one piece inside the rock drilling machine.

According to an embodiment, the disclosed shank adapter and related split components may be utilized in any kind of hydraulic rock drilling machines utilizing a so-called top hammer principle. In this document surface drilling is disclosed only as one example of use, which means that the solution can be used as well in underground drilling machines, bolting devices, exploration devices and any kind of devices wherein top hammering is implemented.

In this document the terms "split" and "split configuration" refer to a structure having non-uniform rim or circumference. The structure can be split or dismantled in radial direction into two, three or more parts or ring-like segments.

The above disclosed embodiments may be combined in order to form suitable solutions having those of the above features that are needed.

BRIEF DESCRIPTION OF THE FIGURES

Some embodiments are described in more detail in the accompanying drawings, in which.

Figure 1:
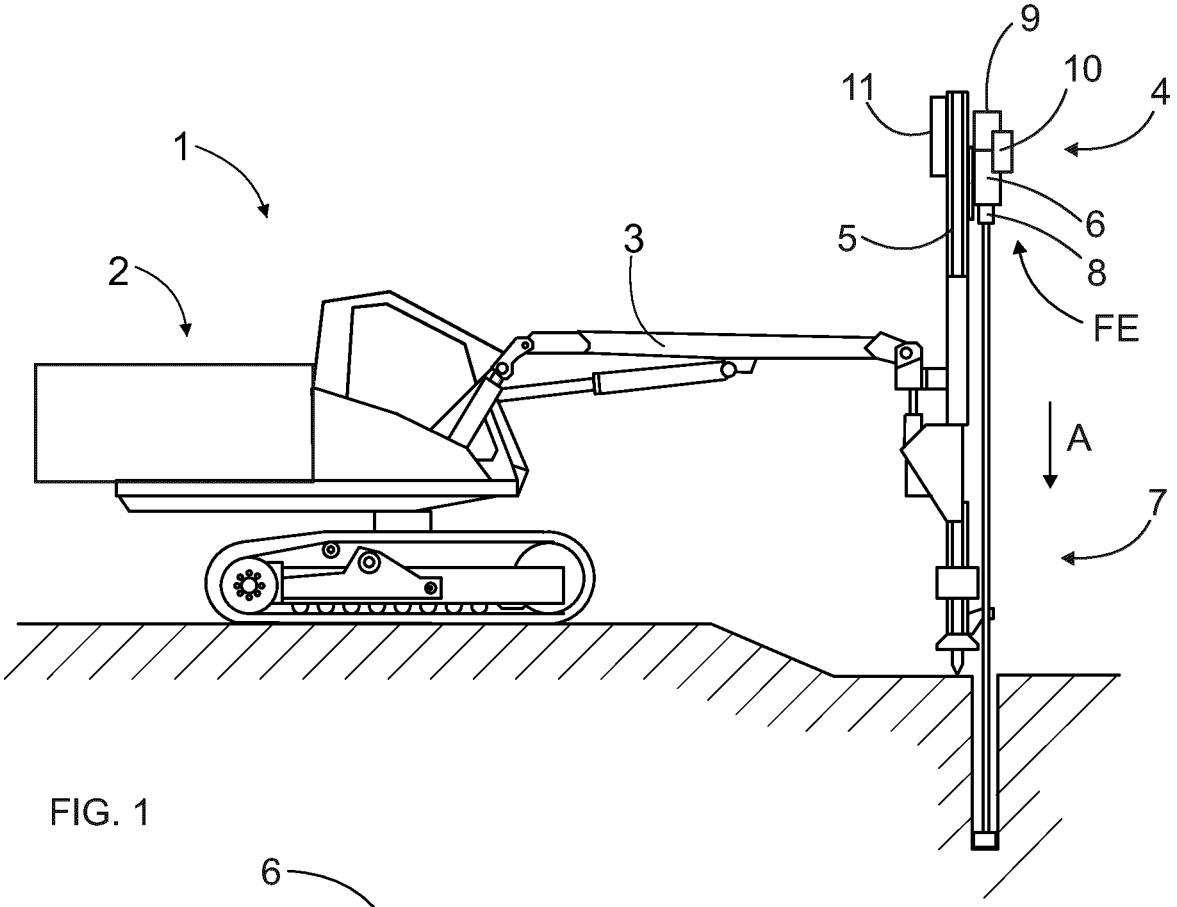
FIG. 1 is a schematic side view of a rock drilling rig for surface drilling.

For the sake of clarity, the figures show some embodiments of the disclosed solution in a simplified manner.

In the figures, like reference numerals identify like elements.

DETAILED DESCRIPTION OF SOME EMBODIMENTS

FIG. 1 shows a rock drilling rig 1 intended for surface drilling. The rock drilling rig 1 comprises a movable carrier 2 and at least one drilling boom 3 connected to the carrier 2. At a distal end portion of the drilling boom 3 is a drilling unit 4 provided with a feed beam 5 and a rock drilling machine 6 supported on it. A drilling tool 7 is connectable to the drilling machine 6. The rock drilling machine 6 comprises a shank adaptor 8 at a front end FE of the rock drilling machine 6 for connecting the tool 7. The rock drilling machine 6 further comprises an impact device 9 and a rotating device 10. The rock drilling machine 6 may be moved towards a drilling direction A on the feed beam 5 by means of a feed device 11. During the drilling impact pulses are generated by means of the impact device to the rotating shank adapter 8 which transmits the impacts pulses and torque to the drilling tool 7. Flushing agent flow is conveyed through a hollow structure to the shank adapter 8 and all the way through the drilling tool 7 to a bottom of the drilled hole for flushing drilling cuttings away from the drilled hole.

Figure 2:
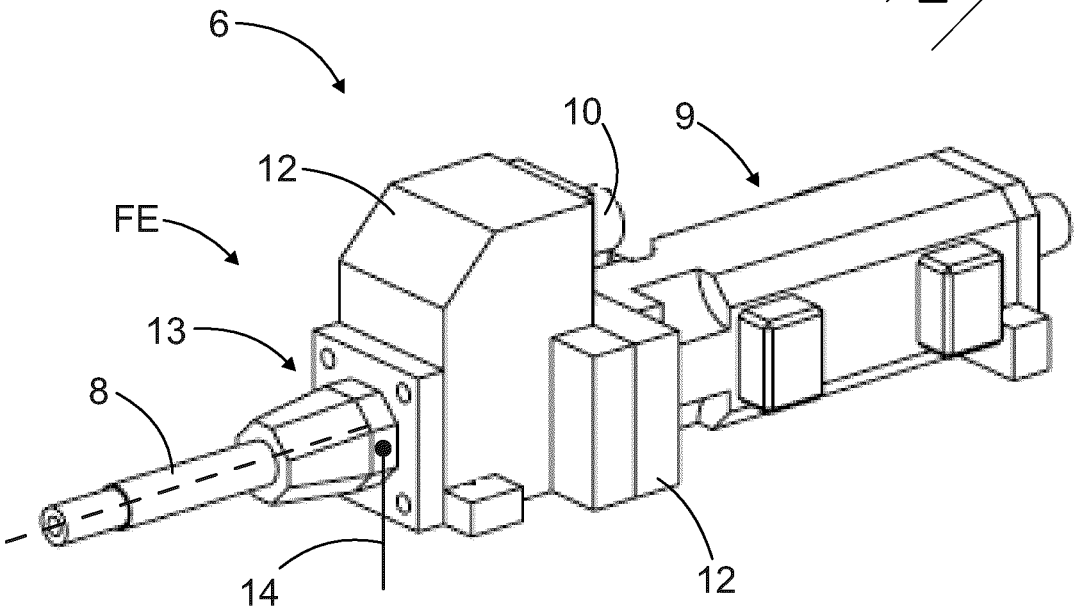
FIG. 2 is a schematic view of a hydraulic rock drilling machine.

FIG. 2 discloses a rock drilling machine 6 comprising a body 12, an impact device 9, a rotating device 10 and a gear housing. Mounted at a front end FE of the body 12 are a flushing housing 13 and a shank adaptor 8. Flushing agent, such as water, is conveyed by means of a flushing channel 14 to the flushing housing 13 or flushing head.

The impact device 9 may comprise an impact piston 48 (shown in FIG. 4) for generating impact pulses IP to the shank adapter 8 in an impact direction. The rotation device 10 and transmission means inside a gear housing make the shank adapter 8 to rotate R around its longitudinal axis as it is shown FIG. 4.

Figure 3:
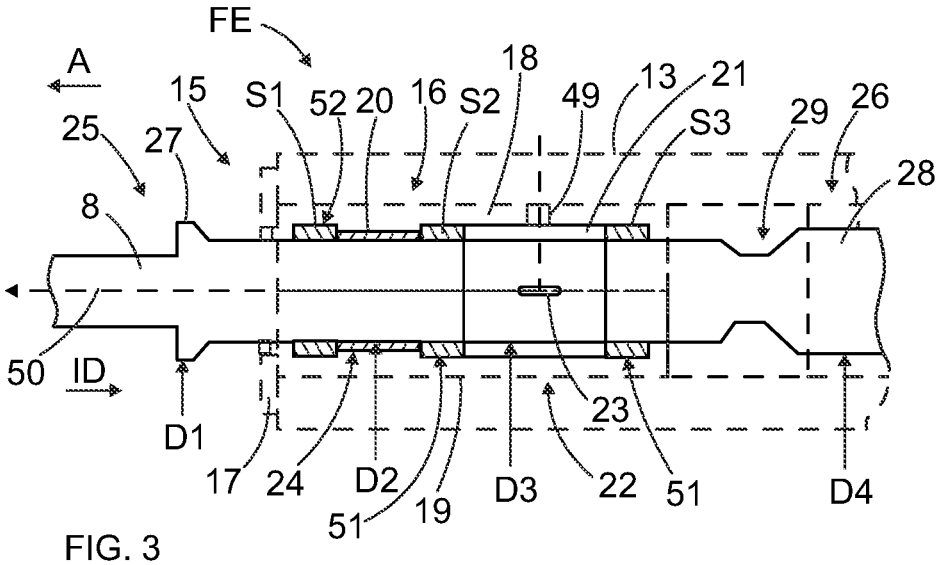
FIG. 3 is a schematic and cross-sectional side view of front part of a rock drilling machine.

FIG. 3 discloses a front end FE of a rock drilling machine in a highly simplified manner. A flushing housing 13 is provided with a pre-assembled shank module 15 comprising a shank adapter 8 and a flushing element 16 assembled around it. The flushing housing 13 may comprise a space inside which the module 15 can be pushed in axial installation direction ID and can be locked in place by means of a flange 17, for example. As can be seen, opposite ends of the shank adapter 8 have greater diameters D1 and D4 compared to diameters D2 and D3 between them. Therefore, the shank adapter 8 cannot be mounted in axial direction inside a frame 18 of a flushing element 19. Instead, the frame 18 has split structure and it comprises two halves mountable to each other in transverse direction. In addition to the frame 18, also sealings S1, S2 and S3, as well as a front bearing element 20 have split configuration. Thus, in the shown structure, the flushing element 19 comprises a split frame, split sealings and split bearings. The frame 18 and seals S2, S3 define together a flushing space 21 around a flushing portion 22 of the shank adapter 8. Flushing agent is fed via a feed opening 49 to a flushing space 21 surrounding the shank adaptor 8 and further through a flushing opening 23 of the shank adapter 8 to an axial passage 50 inside the shank adapter 8 wherein it flows towards a drilling tool.

On an inner surface of the flushing element 19 are at least two sealing housings 51 for receiving flushing sealings S2, S3. The sealing housings 51 are located at axial distance from each other and on opposite sides relative to the flushing space 21. There is also a sealing housing 52 for receiving a front sealing S1. The sealing housings 51, 52 may be sealing grooves or other suitable spaces.

In the disclosed solution diameter D2 of a bearing portion 24 may be minor than diameter D1 of a coupling head 25 of the shank adapter 8 and minor than diameter D4 of a rotation portion 26. This is advantageous for the propagation of the stress waves caused by impact pulses of the impact device. At the coupling head 25, or coupling portion, a shoulder 27 may form the greatest diameter D1. At the rotation portion 26 there may be several splines 28 which are designed to be in contact with a rotating gear of a gearing housing. Greater dimension D1 at the coupling head 25 may be advantageous regarding durability of the coupling and greater dimension D4 at the rotation portion 26 may be advantageous regarding transmission of torque.

The pre-assembled shank module 15 disclosed in FIG. 3 may be supported to the flushing housing 13 also in several alternative ways. For example, it is possible to mount the module 15 in a direction opposite to the disclosed installation direction ID. A further possibility is to design a flushing housing with an openable cover or with a split structure, whereby the module can be installed in one piece in transverse direction.

FIG. 3 further discloses that the shank adapter 8 may comprise surfaces 29 intended for retracting the shank adapter 8 and the connected drilling tool backwards by means of a feed device of a drilling unit when the drilling is completed.

Figure 4:
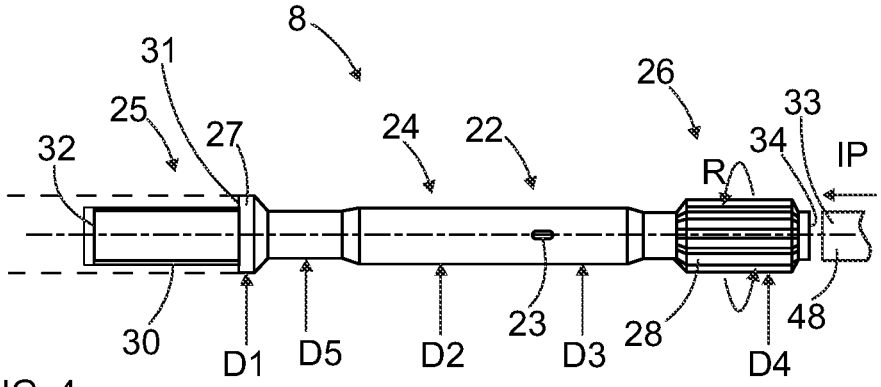
FIG. 4 is a schematic side view of a shank adapter provided with a coupling head implementing shoulder contact with a drilling tool.

FIG. 4 discloses a shank adapter 8 wherein a coupling head 25 comprises a shoulder 27 and a connecting thread 30. The shoulder 27 comprises an axial surface 31 for transmitting impact waves. Between a distal end 32 of the shank adapter 8 and a drilling tool 7 is a clearance. Diameters D1 and D4 are greater than diameters D2 and D3 between them. Diameter of a front bearing of a piston 33 and diameter D3 may be substantially equal. At a rear end of the shank adapter 8 may be a portion for receiving impact pulses and provided with an impact surface 34. Diameter D5 of the impact portion may also be equal or substantially equal to the diameter DP of the percussion piston 33. An advantage of this is that then the stress waves propagate well through the shank adapter 8.

Figure 5:
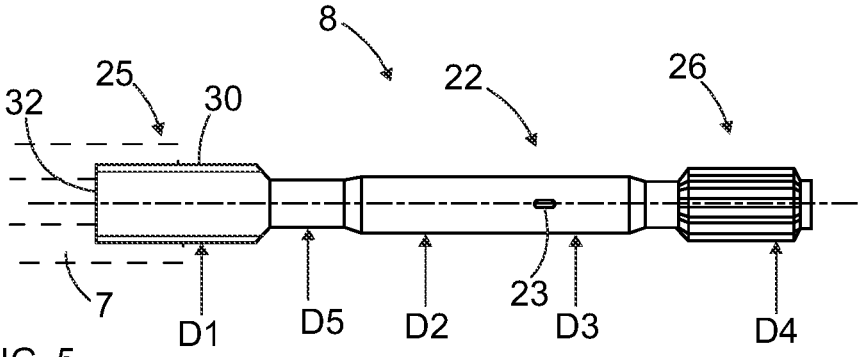
FIG. 5 is a schematic side view of a shank adapter provided with a coupling head comprising a large dimensioned screw surface.

FIG. 4 discloses a so called shoulder contact shank adapter 8, whereas FIG. 5 discloses a so called bottom contact shank adapter 8. In FIG. 5 a distal end 32 of the shank adapter 8 is tightened by means of a thread 30 against a drill tool 7. Diameter D1 of the thread 30 can be dimensioned greater than in typical shank adapters because a split flushing element is intended to be used in connection with it.

In FIGS. 4 and 5 there is further disclosed that the shank adapter 8 may comprise a thinned portion having a diameter D5 which is minor than diameters D1-D4.

There may also be a thinned portion at the flushing opening 23.

Figure 6:
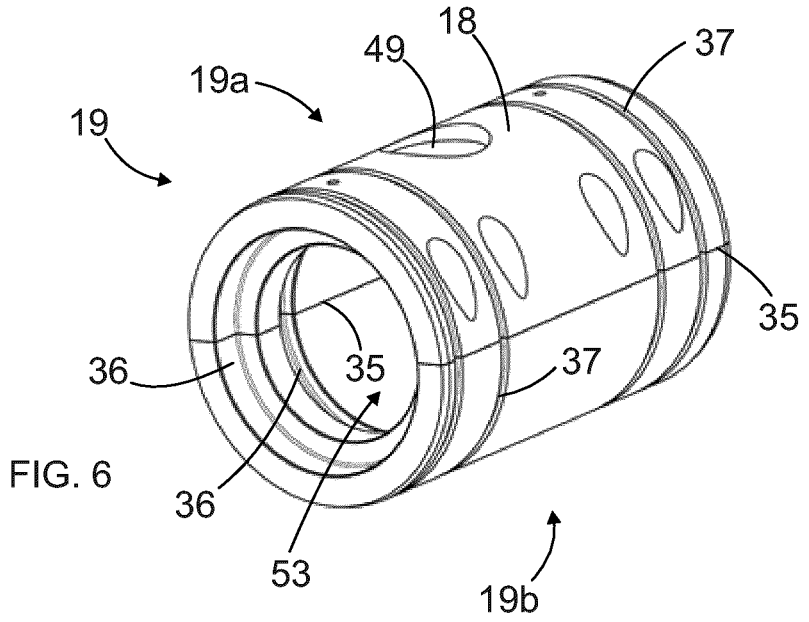
FIG. 6 is a schematic view of a flushing element comprising sleeve-like body with two halves.
Figure 7:
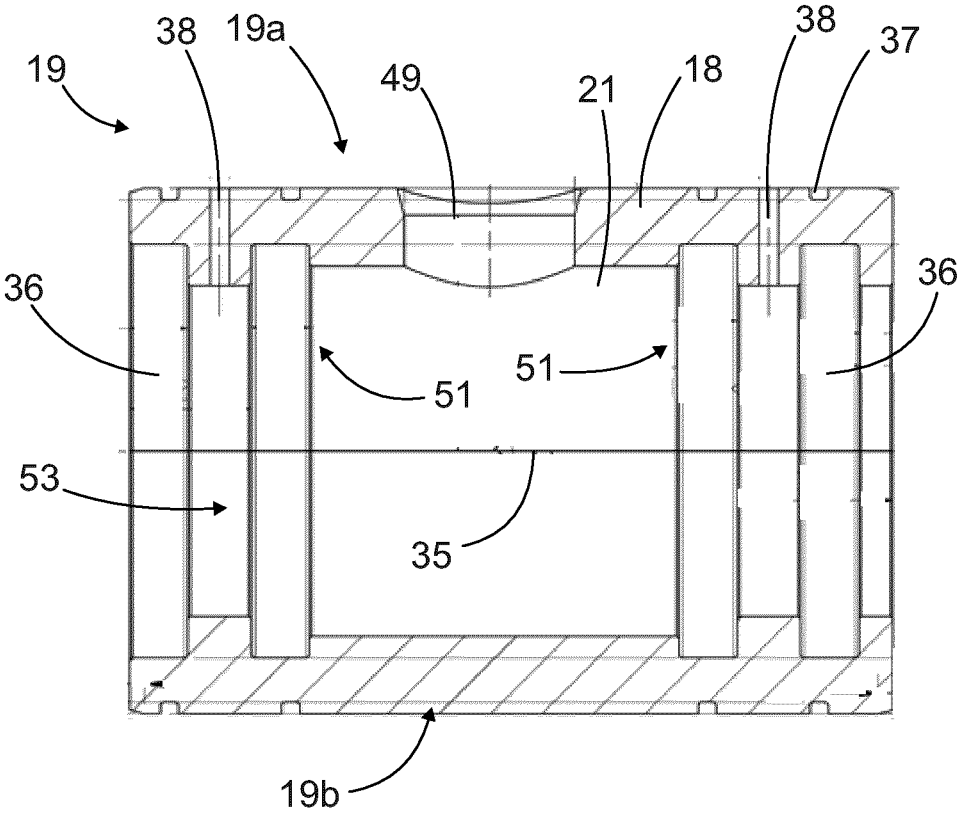
FIG. 7 is a schematic and cross sectional view of the flushing element shown in FIG. 6.

FIGS. 6 and 7 disclose a sleeve-like frame 18 of a flushing element 19 comprising a first halve 19*a* and second halve 19*b*, which can be bolted together. Between the halves 19*a*, 19*b* are joint surfaces or mating surfaces 35. The mating surfaces 35 may be flat or they may be provided with shaped sealing profiles. Further, between the mating surfaces 35 may or may not be a gasket, sealing material or sealing mass. The halves 19*a*, 19*b* may be bolted together or may be connected to each other in any other ways, such as by means of shape locking, for example. The halves 19*a*, 19*b* define together an axial opening 53 inside which a shank adapter is mountable. On an inner surface of the frame 18 are sealing grooves 36 for receiving sealings facing towards a shank adapter. On an outer surface of the frame 18 are several sealing grooves 37 for receiving sealings facing towards a body of a flushing housing. Number of sealings and sealing grooves 36, 37 may be selected according to the need. Further, there may be leakage channels 38 between two successive sealing elements.

Figure 8:
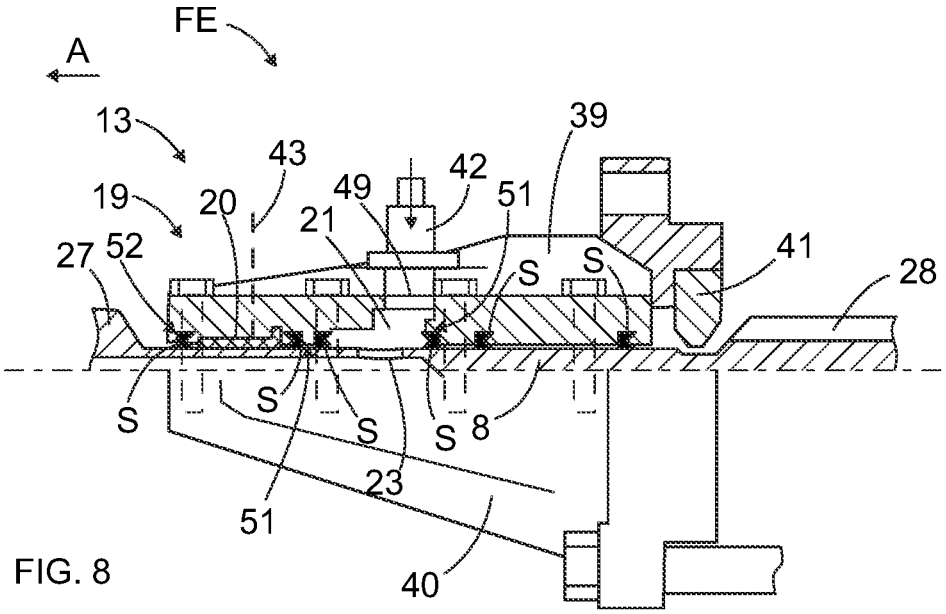
FIG. 8 is a schematic and partly cross sectional side view of a flushing head having a split structure.

FIG. 8 discloses a front end FE of a rock drilling machine comprising a flushing housing 13 provided with an openable cover element 39. In this solution there is a flushing element 19 which is a split flushing housing 19 comprising the cover element 39 which is mountable and demountable to a basic structure 40 or frame of the flushing housing 13. It is easy to dismount and mount the shank adapter 8, seals S and a bearing element 20 in transverse direction when the structure is opened by removing the cover element 39. The cover element 39 may be bolted to the basic structure 40. The seals S and the bearing element 20 have split structures to facilitate their mounting. Also, a support element 41 for serving as retracting aid has a split structure. Flushing agent can be fed through a feed port 42 to a flushing space 21 which may be located on the cover element 39. Further, a lubricating channel 43 may provide the bearing element 20 with proper lubrication.

Figure 9:
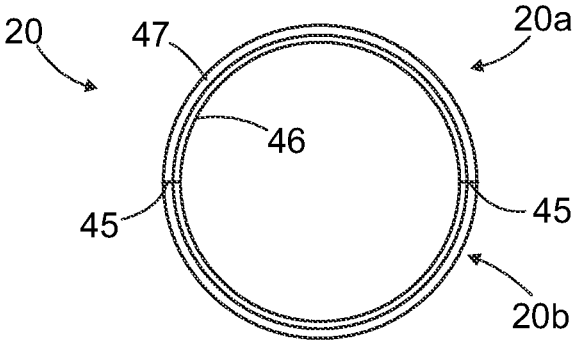
FIG. 9 is a schematic view of a split bearing element seen in axial direction and comprising two halves.

FIG. 9 discloses a bearing element 20 having a split configuration and comprising two bearing components 20*a*, 20*b* and mating surfaces 45 between them. The bearing element 20 may comprise an elongated bearing portion 46 made of slide bearing material, and further a transverse flange 47 at its one end.

The drawings and the related description are only intended to illustrate the idea of the invention. In its details, the invention may vary within the scope of the claims.

The invention claimed is:

1. A rock drilling machine, comprising:

a body;

an impact device arranged for generating impact pulses;

a shank adapter arranged for receiving the impact pulses and transmitting the impact pulses as stress waves to a drilling tool connectable to the shank adapter;

a rotation device arranged for turning the shank adapter around a longitudinal axis;

at least one bearing element arranged for supporting the shank adapter;

a flushing head at a front end of the body, wherein the flushing head includes a flushing element surrounding the shank adapter and configured to form an annular flushing space for feeding flushing agent through the shank adapter to the drilling tool, wherein the bearing element and the flushing element both have split structures including at least two compatible components, and wherein the shank adapter comprises:

a coupling head arranged for connecting the drilling tool;

a rotation portion located at an opposite end portion of the shank adapter relative to the coupling head, the rotation portion including several splines for transmitting torque;

a flushing portion located between the coupling head and the rotation portion, the flushing portion including a transverse flushing opening in contact with an axial flushing portion extending to a distal end of the shank adapter at a coupling head side end, wherein outer diameters of the coupling head and the rotation portion are both greater than outer diameters of the shank adapter located between the coupling head and the rotation portion; and a bearing portion disposed between the coupling head and the rotation portion, and the outer diameters of the coupling head and the rotation portion both being greater than outer diameters of the flushing portion and the bearing portion.

2. The rock drilling machine as claimed in claim 1, wherein a smallest diameter of the two outer diameters of the coupling head and the rotation portion is at least 5% greater than the greatest outer diameter between the coupling head and the rotation portion.

3. The rock drilling machine as claimed in claim 1, wherein a smallest diameter of the two outer diameters of the coupling head and the rotation portion is at least 4 mm greater than the greatest outer diameter between the coupling head and the rotation portion.

4. The rock drilling machine as claimed in claim 1, wherein the coupling head includes a shoulder provided with an axial contact surface and a protruding axial part provided with a coupling thread, and wherein an outer diameter of the shoulder is greater than the diameter of the coupling head.

5. A method of mounting a shank adapter of a rock drilling machine inside a slide bearing element, the method comprising:

providing a rock drilling machine according to claim 1;

implementing a split bearing element including at least two connectable bearing components;

connecting the shank adapter and the split bearing element together by means of transverse relative movement between the shank adapter and the bearing components; and pre-assembling the bearing element around the shank adapter and mounting a combination of the shank adapter and the bearing element in one piece inside the rock drilling machine.

* * * * *